US009905115B2

(12) United States Patent
Venkatesh et al.

(10) Patent No.: US 9,905,115 B2
(45) Date of Patent: Feb. 27, 2018

(54) SYSTEMS AND METHODS FOR INSTALLING, COMMISSIONING, TESTING, AND MAINTAINING A FIRE ALARM CONTROL PANEL VIA A MOBILE DEVICE

(71) Applicant: Honeywell International Inc., Morristown, NJ (US)

(72) Inventors: Balamurugan Venkatesh, Hosur (IN); Sameesh Mukundan, Calicut (IN)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 0 days.

(21) Appl. No.: 15/200,427

(22) Filed: Jul. 1, 2016

(65) Prior Publication Data

US 2018/0005513 A1 Jan. 4, 2018

(51) Int. Cl.
*G08B 25/00* (2006.01)
*G08B 17/00* (2006.01)

(52) U.S. Cl.
CPC ..... *G08B 25/008* (2013.01); *G08B 17/00* (2013.01)

(58) Field of Classification Search
CPC ..... G08B 25/008; G08B 17/00
See application file for complete search history.

(56) References Cited

U.S. PATENT DOCUMENTS

2008/0084291 A1* 4/2008 Campion ..... G08B 29/145 340/514
2015/0097664 A1* 4/2015 Breed ..... G08B 29/00 340/506
2015/0142898 A1 5/2015 Piccolo, III
2015/0161621 A1* 6/2015 Becker ..... G06Q 30/0185 705/318
2015/0206421 A1* 7/2015 Moffa ..... G08B 29/043 340/514
2017/0076585 A1* 3/2017 El-Mankabady ..... G08B 3/10

OTHER PUBLICATIONS

Extended EP Search Report for corresponding EP patent application 17179021.5, dated Nov. 7, 2017.

* cited by examiner

*Primary Examiner* — Brian Wilson
(74) *Attorney, Agent, or Firm* — Husch Blackwell LLP

(57) ABSTRACT

Systems and methods for installing, commissioning, testing, and maintaining a fire alarm control panel via a mobile device are provided. Some methods can include receiving a first signal from a fire alarm control panel device, the first signal containing identifying information of the fire alarm control panel device, transmitting a second signal containing the identifying information to a server device, receiving a third signal containing a second piece of information from the server device, and displaying the second piece of information on a user interface device, wherein the second piece of information includes information for installing, commissioning, testing, or maintaining the fire alarm control panel device.

18 Claims, 1 Drawing Sheet

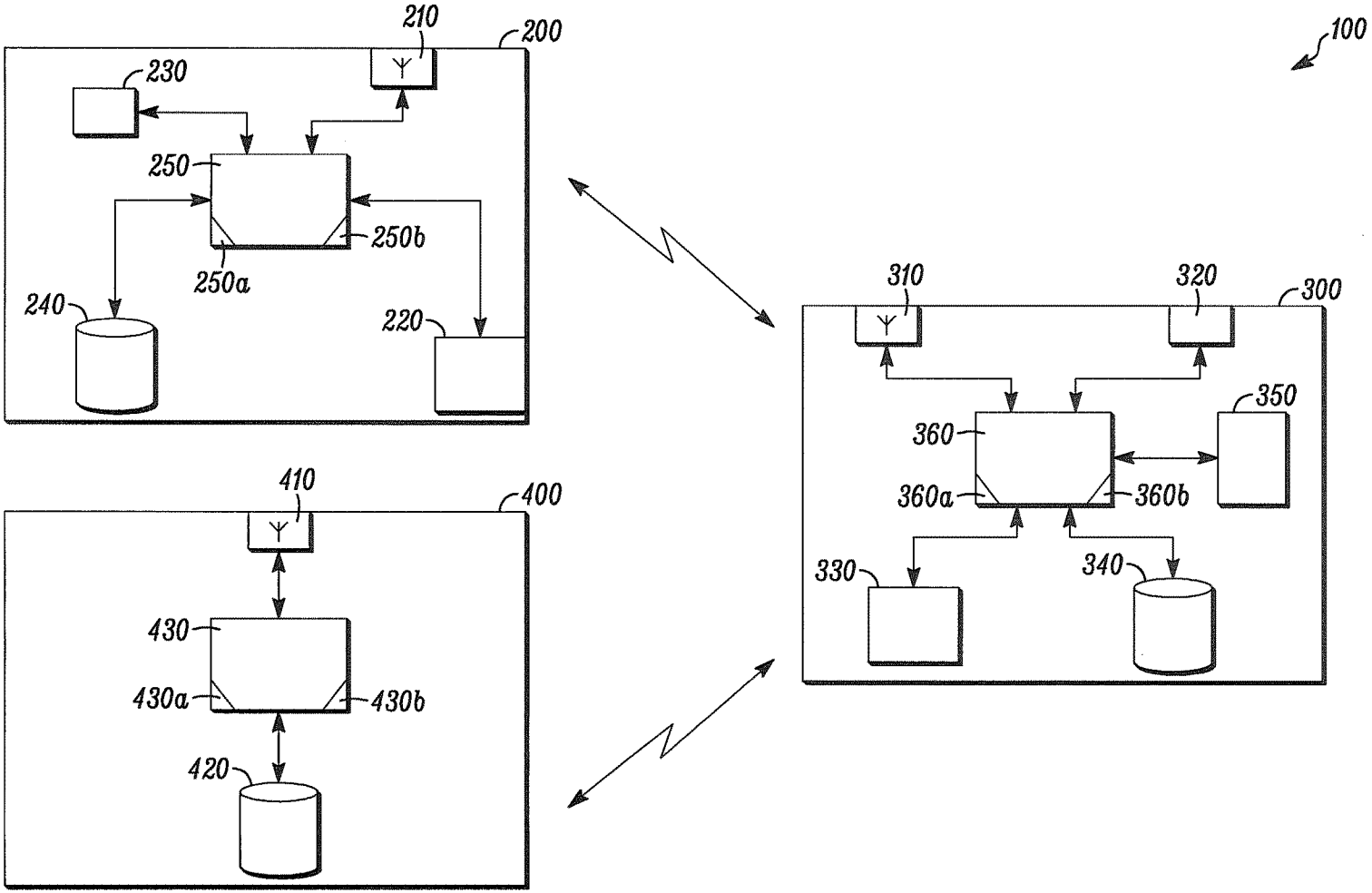
100
300
350
320
360b
340
360
360a
310
330
200
210
250b
220
230
250
250a
240
400
410
430b
430
430a
420

SYSTEMS AND METHODS FOR INSTALLING, COMMISSIONING, TESTING, AND MAINTAINING A FIRE ALARM CONTROL PANEL VIA A MOBILE DEVICE

FIELD

The present invention relates generally to fire alarm control panels. More particularly, the present invention relates to systems and methods for installing, commissioning, testing, and maintaining a fire alarm control panel via a mobile device.

BACKGROUND

Known user interfaces of fire alarm control panels are not cost effective or easy to use and do not quickly provide a necessary information for installing, commissioning, testing, and maintaining a fire alarm control panel. For example, known user interfaces are not intuitive and do not easily or quickly guide a user to program the fire alarm control panel. Indeed, it may be necessary to identify detailed information from user manuals and have more than fundamental system knowledge to install, commission, test, and maintain the fire alarm control panel.

In view of the above, there is a continuing, ongoing need for improved systems and methods.

BRIEF DESCRIPTION OF THE DRAWINGS

FIG. 1 is a block diagram of a system in accordance with disclosed embodiments.

DETAILED DESCRIPTION

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein can include systems and methods for installing, commissioning, testing, and maintaining a fire alarm control panel via a mobile device. For example, in some embodiments, systems and methods disclosed herein can include the fire alarm control panel with one or more wireless interfaces or transceivers, a fire alarm control panel application executed on the mobile device, and a server device. In some embodiments, the mobile device disclosed herein can include, but is not limited to a tablet, a smart phone, a personal digital assistant, and the like.

In some embodiments, the one or more wireless interfaces or transceivers of the fire alarm control panel can support and communicate via a product tag, a RF signal, and a receiver, via a Bluetooth signal, or via a WiFi signal. For example, in some embodiments, the fire alarm control panel can include the first wireless interface that can include a product tag and that can support and communicate via a first type of signal, for example, the RF signal, and a second wireless transceiver that can support and communicate via a second type of signal, for example, the Bluetooth signal or the WiFi signal.

In some embodiments, the mobile device can include one or more wireless interfaces or transceivers that can support and communicate via the RF signal, the Bluetooth signal, or the WiFi signal. Accordingly, in some embodiments, the mobile device can communicate with the one or more wireless interfaces or transceivers of the fire alarm control panel via the first and/or second types of signals and with the server device via the first and/or second types of signals. In this manner, the mobile device can be used to wirelessly install, commission, test, and maintain the fire alarm control panel, for example, by receiving, via the fire alarm control panel and/or the server device, programming information, flash upgrade data, historical data, and information related to testing and maintenance activities.

In accordance with disclosed embodiments, the fire alarm control panel and the mobile device can communicate with one another, via respective wireless interfaces or transceivers, to initiate a session or to pair with one another. In some embodiments, the mobile device or a user thereof can be preassigned a unique identification number that can authorize the mobile device or the user thereof to program the fire alarm control panel. For example, the mobile device can transmit its identification number to the fire alarm control panel, and the fire alarm control panel can make a determination as to whether the fire alarm control panel will further communicate with the mobile device based on whether the received identification number is authorized.

If the mobile device, or the user thereof, is authorized for communication, the fire alarm control panel can transmit information related to the fire alarm control panel to the mobile device, and the mobile device can transmit received fire alarm control panel information and other user input or other mobile device information to the server device. In some embodiments, the user input or the mobile device information can include location information of the mobile device.

In some embodiments, the server device can include a database device that can cross-reference fire alarm control panel information and/or the user input or other mobile device information with related information, such as, for example, work flow templates or regulatory guidance and instructions for the installation, commissioning, testing, and maintenance procedures stored on the server device. The server device can retrieve the appropriate work flow template or regulatory guidance or instructions based on the received fire alarm control panel information and/or user input or mobile device information and transmit the retrieved work flow template or regulatory guidance or instructions to the mobile device. For example, in some embodiments, the server device can identify the regulatory guidance and information based on the location information of the mobile device. The mobile device can display the received work flow template or regulatory guidance or instructions and receive additional user input for navigating the displayed information.

FIG. 1 is a block diagram of a system 100 in accordance with disclosed embodiments. As seen in FIG. 1, the system 100 can include a fire alarm control panel device 200, a mobile device 300, and a server device 400. The fire alarm control panel device 200 can include a first wireless interface device or transceiver 210, a second wireless interface device or transceiver 220, a user interface device 230, and a database device 240, each of which can be in communication with control circuitry 250, one or more programmable processors 250*a*, and executable control software 250*b* as would be understood by one of ordinary skill in the art. Similarly, the mobile device 300 can include a first wireless interface device or transceiver 310, a second wireless interface device or transceiver 320, a user interface device 330, a database device 340, and a GPS device 350, each of which can be in communication with control circuitry 360, one or more programmable processors 360*a*, and executable control software 360*b* as would be understood by one or ordinary skill in the art. The server device 400 can also include a wireless interface transceiver 410 and a database device 420, each of which can be in communication with control circuitry 430, one or more programmable processors 430*a*, and executable control software 430*b* as would be understood by one or ordinary skill in the art.

In some embodiments, the executable control software 360*b* of the mobile device 300 can include a fire alarm control panel application that can execute and control some of the methods described above and herein. Each of the executable control software 250*b*, 360*b*, and 430*b* can be stored on a transitory or non-transitory computer readable medium, including, but not limited to local computer memory, RAM, optical storage media, magnetic storage media, flash memory, and the like. In some embodiments, some or all of the control circuitry 250, 360, 430, the one or more programmable processors 250*a*, 360*a*, 430*a*, and the executable control software 250*b*, 360*b*, 430*b* can execute and control the methods described above and herein.

For example, the mobile device 300 can obtain information related to the fire alarm control panel device 200 by communicating with the fire alarm control panel device via one or more of the wireless interface devices or transceivers 210, 220, 310, 320. In some embodiments, the first wireless interface device 210 can include a wireless product tag, and the first wireless interface device 310 can include a wireless product tag scanner or receiver. In these embodiments, the mobile device 300 can initiate communication with the fire alarm control panel device 200 by tapping the wireless interface device 310 on the wireless interface device 210 to cause the wireless interface device 210 to transmit to the wireless interface device 310 an RF signal that includes information stored in the database device 240 and related to the fire alarm control panel device 200. Additionally or alternatively, in some embodiments, each of the second wireless interface transceivers 220, 320, can include a transceiver device that can support and communicate via a Bluetooth signal or a WiFi signal, and the mobile device 300 can communicate with the fire alarm control panel device 200 via such signals. For example, the mobile device 300 can initiate communication with the fire alarm control panel device 200 by the wireless transceiver 320 transmitting an initial signal to the wireless transceiver 220.

In some embodiments, the wireless interface device or transceiver 310, 320 can transmit an identification number of the mobile device 300 stored in the database device 340 or of a user thereof received via the user interface device 330 to the wireless interface device or transceiver 210, 220. The fire alarm control panel device 200 can determine that the mobile device 300 or the user thereof is authorized by identifying the identification number in the database device 240 prior to the wireless interface device or transceiver 210, 220 transmitting to the wireless interface device or transceiver 310, 320 the information stored in the database device 240 and related to the fire alarm control panel device 200.

As explained above, the fire alarm control panel device 200 can transmit the information stored in the database device 240 and related to the fire alarm control device 200 to the mobile device 300. In some embodiments, such information can include a type, a variant, or other details about the fire alarm control panel device 200.

The mobile device 300 can transmit to the server device 400 the received information related to the fire alarm control panel device 200. For example, the mobile device 300 can communicate with the server device 400 via one or more of the wireless interface devices or transceivers 310, 320, 410. In some embodiments, each of the wireless interface devices or transceivers 310, 320, 410 can include a transceiver device that can support and communicate via the Bluetooth signal or the WiFi signal, and the mobile device 300 can communicate with the server device 400 via such signals.

In some embodiments, the mobile device 300 can receive user input via the user interface device 330 and/or identify a location of the mobile device 300, which can be indicative of a location of the fire alarm control panel device 200 by proximity thereto, via the GPS device 350. In these embodiments, the mobile device 300 can transmit the received user input and/or the identified location of the mobile device 300 to the server device 400 with the received information related to the fire alarm control panel device 200.

Upon receipt of the information and/or the user input from the mobile device 300, the server device 400 can identify and retrieve one or more templates or regulatory guidance or instructions documents in the database device 420 that correspond to the received information or user input, and the server device 400 can transmit the retrieved templates or regulatory guidance or instructions documents to the mobile device 300 via the wireless interface devices or transceivers 310, 320, 410. Upon receipt of the templates or regulatory guidance or instructions documents from the server device 400, the mobile device 300 can display the received templates or regulatory guidance or instructions documents on the user interface device 330 and can receive user input via the user interface device 300 for navigating through the displayed templates or documents.

In accordance with disclosed embodiments, displaying the templates and regulatory guidance or instructions documents on the user interface device 330, as opposed to the user interface device 230, is advantageous because the user interface device 330 of the mobile device 300 is more intuitive for the user to quickly and easily navigate through displayed information and can display more information than can be displayed on the user interface device 230 of the fire alarm control panel device 200. Furthermore, it can be more cost effective to display the templates and regulatory guidance or instructions documents on the user interface device 330 of the mobile device 300 than to upgrade the user interface device 230 of the fire alarm control panel device 200. Even further still, the mobile device 300 can retrieve information from the server device 400 that is more detailed, relevant, and helpful to the user than what can be stored in the database device 240 of the fire alarm control panel device 200.

Although a few embodiments have been described in detail above, other modifications are possible. For example, the logic flows described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A method comprising:

a user interface device receiving a first signal from a fire alarm control panel device, the first signal containing identifying information of the fire alarm control panel device;

the user interface device transmitting a second signal containing the identifying information and mobile device information corresponding to the user interface device to a server device;

the user interface device receiving a third signal containing a second piece of information from the server device; and the user interface device displaying the second piece of information on a display of the user interface device, wherein the second piece of information includes information for installing, commissioning, testing, or maintaining the fire alarm control panel device, and wherein the second piece of information is identified based on the identifying information and the mobile device information.

2. The method of claim 1 further comprising the user interface device transmitting a fourth signal to the fire alarm control panel device prior to receiving the first signal from the fire alarm control panel device, wherein the fourth signal includes an authorized identification number.

3. The method of claim 2 further comprising the user interface device retrieving the authorized identification number from a database device.

4. The method of claim 2 further comprising the user interface device receiving user input including the authorized identification number.

5. The method of claim 1 further comprising:

the user interface device receiving the first signal via a first communication medium; and the user interface device transmitting the second signal and receiving the third signal via a second communication medium, wherein the first communication medium is different than the second communication medium.

6. The method of claim 1 further comprising:

the user interface device receiving user input; and the user interface device transmitting the user input to the server device in the second signal, wherein the second piece of information is identified based on the user input.

7. The method of claim 1 further comprising:

the user interface device identifying an ambient geographical location; and the user interface device transmitting the ambient geographical information to the server device in the second signal, wherein the second piece of information is identified based on the ambient geographical information.

8. The method of claim 1 wherein the second piece of information includes a work flow template, a regulatory guidance document, or an instructions document.

9. The method of claim 1 further comprising:

the user interface device receiving user input; and the user interface device adjusting the second piece of information displayed on the user interface device based on the user input.

10. A system comprising:

a transceiver;

a user interface device housing the transceiver;

a programmable processor of the user interface device; and executable control software stored on a non-transitory computer readable medium of the user interface device, wherein the transceiver receives a first signal from a fire alarm control panel device, wherein the first signal contains identifying information of the fire alarm control panel device, wherein the programmable processor and the executable control software cause the transceiver to transmit a second signal containing the identifying information and mobile device information corresponding to the user interface device to a server device, wherein the transceiver receives a third signal containing a second piece of information from the server device, wherein the programmable processor and the executable control software cause a display of the user interface device to display the second piece of information, wherein the second piece of information is identified based on the identifying information and the mobile device information, and wherein the second piece of information includes information for installing, commissioning, testing, or maintaining the fire alarm control panel device.

11. The system of claim 10 wherein the programmable processor and the executable control software cause the transceiver to transmit a fourth signal to the fire alarm control panel device prior to receiving the first signal from the fire alarm control panel device, and wherein the fourth signal includes an authorized identification number.

12. The system of claim 11 further comprising:

a database device of the user interface device, wherein the programmable processor and the executable control software retrieve the authorized identification number from the database device.

13. The system of claim 11 wherein the programmable processor and the executable control software cause the transceiver to transmit the fourth signal responsive to user input received via the user interface device.

14. The system of claim 10 wherein the transceiver includes a first transceiver device and a second transceiver device, wherein the first transceiver device receives the first signal via a first communication medium, wherein the second transceiver device transmits the second signal and receives the third signal via a second communication medium, and wherein the first communication medium is different than the second communication medium.

15. The system of claim 10 wherein the user interface device receives user input, wherein the programmable processor and the executable control software cause the transceiver to transmit the user input in the second signal, and wherein the second piece of information is identified based on the user input.

16. The system of claim 10 further comprising:

a GPS device of the user interface device, wherein the GPS device identifies an ambient geographical location, wherein the programmable processor and the executable control software cause the transceiver to transmit the ambient geographical location in the second signal, and wherein the second piece of information is identified based on the ambient geographical information.

17. The system of claim 10 wherein the second piece of information includes a work flow template, a regulatory guidance document, or an instructions document.

18. The system of claim 10 wherein the user interface device receives user input, and wherein the programmable processor and the executable control software cause the user interface device to adjust the second piece of information displayed on the user interface device based on the user input.

* * * * *